US007491110B2

(12) United States Patent
Chernick et al.

(10) Patent No.: US 7,491,110 B2
(45) Date of Patent: Feb. 17, 2009

(54) VIBRATING TOY WITH ELASTOMERIC PROTRUSIONS AND ITS ASSOCIATED METHOD OF ASSEMBLY

(76) Inventors: Mark Chernick, 19180 144th Ave., N.E., Woodinville, WA (US) 98072; Weeb T. Nelson, 19180 144th Ave., N.E., Woodinville, WA (US) 98072

( * ) Notice: Subject to any disclaimer, the term of this patent is extended or adjusted under 35 U.S.C. 154(b) by 73 days.

(21) Appl. No.: 11/234,736

(22) Filed: Sep. 26, 2005

(65) Prior Publication Data

US 2007/0087654 A1 Apr. 19, 2007

(51) Int. Cl.
*A63H 3/44* (2006.01)

(52) U.S. Cl. ..... 446/268; 446/391; 446/394; 446/484

(58) Field of Classification Search ..... 446/3, 446/9, 175, 236, 65, 437, 353, 484, 354–356, 446/268, 391, 394
See application file for complete search history.

(56) References Cited

U.S. PATENT DOCUMENTS 3,798,835 A 3/1974 McKeehan ..... 46/243
4,375,733 A * 3/1983 Callais, Jr. ..... 446/295
4,867,726 A * 9/1989 Fujimaki ..... 446/175
5,176,560 A * 1/1993 Wetherell et al. ..... 446/175
5,297,981 A 3/1994 Maxim et al. ..... 446/437
5,413,551 A * 5/1995 Wu ..... 601/46
5,649,964 A * 7/1997 Berman et al. ..... 606/235
6,071,170 A * 6/2000 How ..... 446/330
6,592,426 B2 * 7/2003 Mesch ..... 446/310
6,684,556 B1 * 2/2004 Arbuckle et al. ..... 43/17.1
6,991,511 B2 * 1/2006 Maggiore et al. ..... 446/330
7,165,869 B2 * 1/2007 Chernick et al. ..... 362/363

* cited by examiner

*Primary Examiner*—Kien Nguyen
(74) *Attorney, Agent, or Firm*—LaMorte & Associates, P.C.

(57) ABSTRACT

A novelty device having a vibrating mechanism that is disposed at least partially within a housing. The vibrating mechanism causes the housing to vibrate when activated. A plurality of elongated elastomeric protrusions are provided that extend outwardly from the housing. The elastomeric protrusions undulate when the housing is vibrated by the vibrating mechanism. The housing can be shaped as a character having a head section. The elastomeric protrusions can be placed on the head section of the character so that the protrusions have the appearance of hair. When the vibrating mechanism is activated, the protrusions undulate wildly, thereby causing the character's hair to appear to be alive.

7 Claims, 5 Drawing Sheets

VIBRATING TOY WITH ELASTOMERIC PROTRUSIONS AND ITS ASSOCIATED METHOD OF ASSEMBLY

BACKGROUND OF THE INVENTION

1. Field of the Invention

The present invention relates to toys and novelty devices that contain internal, battery-operated vibrating mechanisms.

2. Prior Art Description

Many toys, such as dolls, balls and the like are commonly held by children. Toy manufacturers have long ago discovered that the play value of most any toy, especially those that are held, can be increased if the toy is made to vibrate or otherwise move. For instance, plush stuffed animal toys have been in existence for hundreds of years. Talking dolls have also been in existence for many years. When an internal vibrating mechanism was added to a talking Elmo® doll, and was marketed as the Tickle Me Elmo® doll, the doll became a sudden commercial success.

The prior art is replete with vibrating mechanisms that have been used in toys. However, when a vibrating mechanism is added to a toy, a child typically cannot tell if the vibration mechanism is activated unless the child is holding the toy. Often, the vibrating mechanism added to a toy is a low-powered device, that vibrates the toy just enough to be felt. However, the appearance of the toy remains the same whether or not the vibration device is activated or deactivated. In some instances, strong vibrating devices are added to toys. Such vibrating devices are typically added to balls so that the vibrating device makes the ball roll or randomly move. Such prior art devices are exemplified by U.S. Pat. No. 5,297,981 to Maxim, entitled Self-propelled Bouncing Ball and U.S. Pat. No. 3,798,835 to McKeehan, entitled Motor Driven Ball Toy. However, with such prior art toys, although the vibrating device makes the toy move, the vibrating device does not change the external appearance of the toy.

The present invention is a vibrating toy that has elastomeric protrusions. The elastomeric protrusions resonate as the toy vibrates. This causes very fast and wild undulations in the elastomeric elements, thereby causing the toy to change greatly in appearance when an internal vibrating device is activated.

SUMMARY OF THE INVENTION

The present invention is a novelty device that vibrates. The novelty device has a housing. A vibrating mechanism is disposed at least partially within the housing. The vibrating mechanism causes the housing to vibrate when activated. An elastomeric cover is stretched over at least part of the housing. A plurality of elongated elastomeric protrusions can be provided that extend outwardly from the housing. The elastomeric protrusions undulate when the housing is vibrated by the vibrating mechanism.

The housing can be shaped as a character having a head section. The elastomeric protrusions can be placed on the head section of the character so that the protrusions have the appearance of hair. When the vibrating mechanism is activated, the protrusions undulate wildly, thereby causing the character's hair to appear to be alive.

Alternatively, the entire housing can be covered by the elastomeric cover, wherein the elastomeric cover itself undulates when the internal vibrating mechanism is activated.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
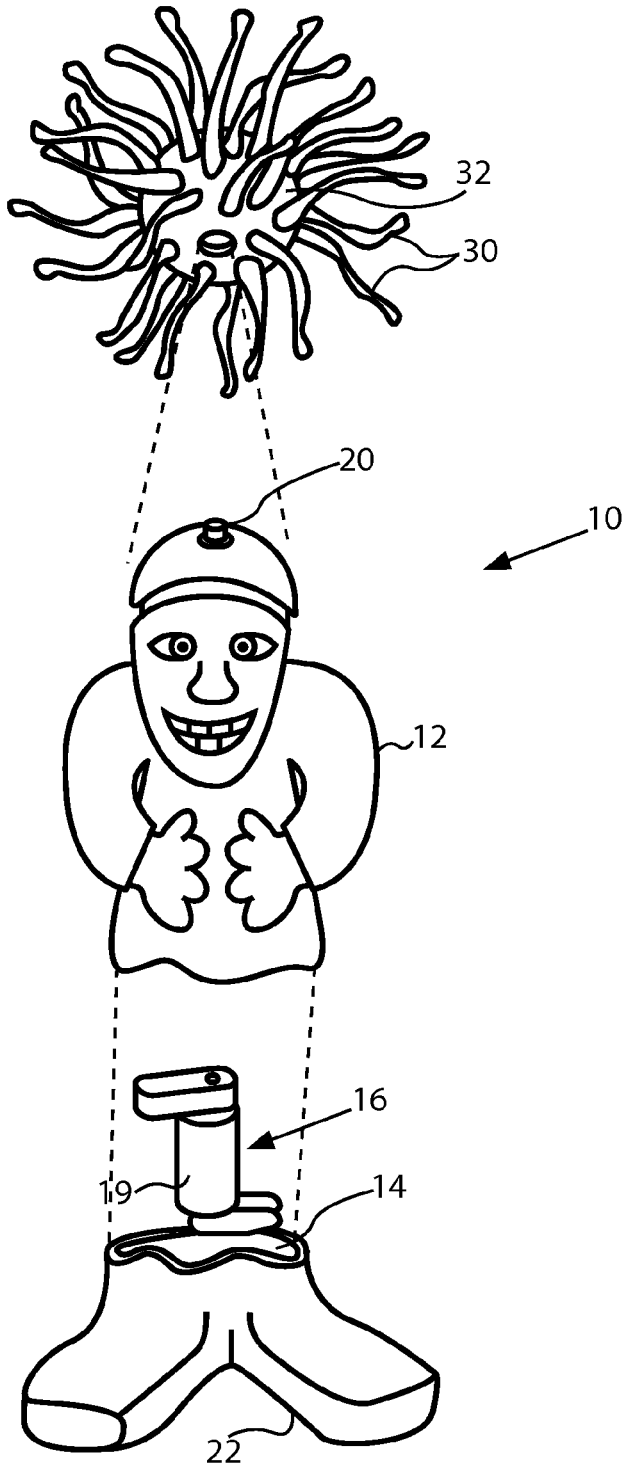
FIG. 1 is an exploded perspective view of an exemplary embodiment of the present invention novelty device.

Referring to FIG. 1, there is shown a first exemplary embodiment of the present invention novelty device 10. The shown embodiment consists of three primary components. The first primary component is a housing 12. The housing 12 defines an interior chamber 14. The second primary component is a battery operated vibrating mechanism 16. The vibrating mechanism 16 has at least one eccentric mounted weight 18 that is rotated by a motor 19. As the eccentric mounted weight 18 rotates, it causes the vibrating mechanism 16 to vibrate.

The vibrating mechanism 16 is held within the internal chamber 14 of the housing 12. In this manner, when the vibrating mechanism 16 is activated, the housing 12 vibrates with the vibrating mechanism 16. A battery receptacle 21 is positioned on the bottom surface 22 of the housing 12. The battery receptacle 21 receives the batteries needed to power the vibrating mechanism 16. An on/off switch 20 is positioned at the top of the housing 12. In this manner, by touching the top of the housing 12, the internal vibrating mechanism 16 can be selectively activated and deactivated.

The third primary component of the novelty device 10 is an elastomeric cap 32. In the shown embodiment, a plurality of flexible elongated protrusions 30 extend from the elastomeric cap 32. The elastomeric cap 32 and the protrusions 30 are preferably molded from an elastomeric material. The elastomeric cap 32 has at least one access opening formed along its periphery. The protrusions 30 extend radially from the exterior of the elastomeric cap 32. The protrusions 30 have a preferred length of at least one and a half inches. Furthermore, it is preferred that the protrusions have a wide base and taper toward a top termination point. In this manner, the protrusions 30 decrease in mass along their length. This helps the protrusions undulate when vibrated.

The elastomeric cap 32 and the protrusions 30 are preferably made from an elastomeric gel material such as a poly (styrene-ethylene-ethylene-propylene-styrene) copolymer mixed between two percent and twenty percent, by weight, with a plasticizing oil, such as mineral oil. The resulting composition is both highly elastic and highly tear resistant. An oxidizing agent can also be added to the elastic polymer composition to reduce the tackiness of the elastic polymer composition. Alternate tri-block copolymers such as poly (styrene-ethylene-propylene-styrene) can also be used.

Figure 2:
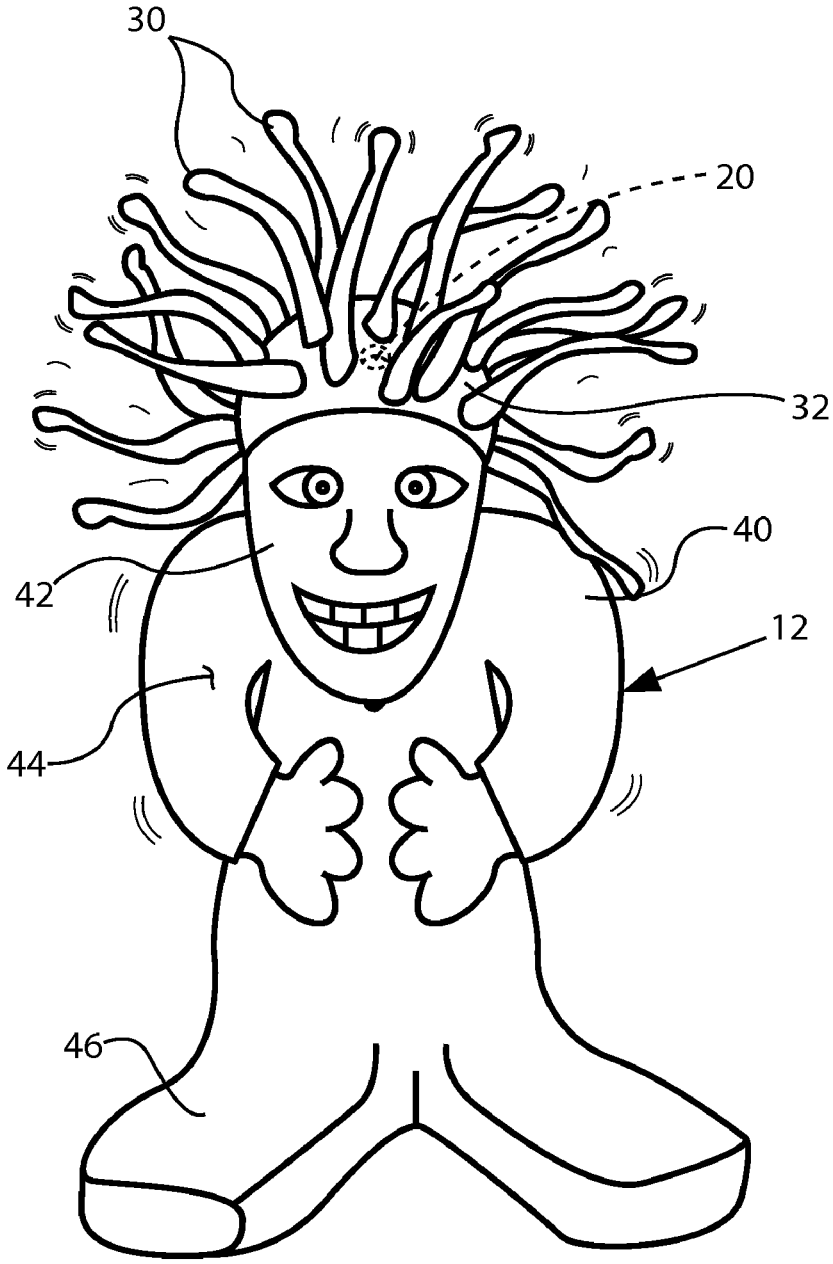
FIG. 2 is a front view of the embodiment of the present invention novelty device shown in FIG. 1.

Referring to FIG. 2, it can be seen that the housing 12 can be shaped as a character 40. The character 40 can be an animal or a humanoid having a head section 42 and a body section 44. It is preferred that the character 40 also have enlarged feet 46 at the bottom of the body section 44 so that the housing 12, in the form of the character 40, can be easily self-standing on a flat surface. The vibrating mechanism 16 is disposed within the housing 12. Consequently, when the vibrating mechanism 16 is activated, the character 40 vibrates.

The elastomeric cap 32 attaches to the head section 42 of the character 40, so as to appear to be the hair of the character 40. In the shown embodiment, the elastomeric cap 32 is stretched over the head section 42 of the character 40. The elastomeric cap 32 can be glued in place, but is preferably removable. When the vibrating mechanism 16 is activated, the protrusions 30 that extend from the elastomeric cap 32 resonate at the frequency of vibration provided by the vibrating mechanism 16. The protrusions 30 therefore writhe and otherwise undulate in random directions. The protrusions 30 therefore appear to be a living moving object, making the overall appearance of the character 40 highly novel.

The on/off switch 20 can be placed at any point on the housing 12. However, the on/off switch 20 of the vibrating mechanism 16 is preferably positioned at the top of the housing 12, in the head section 42 of the character 40. This positions the on/off switch 20 under the elastomeric cap 32. As a result, in order to activate and deactivate the vibrating mechanism 16, a person must strike the top of the head section 42 of the character 40 through the protrusions 30 and elastomeric cap 32. Thus, the character 40 can be activated and deactivated by striking the character 40 on its head section 42. The positioning of the on/off switch 20 in the head section, therefore induces a child to touch the moving protrusions 30 as they are vibrating, thereby adding play value to the novelty device 10.

Figure 3:
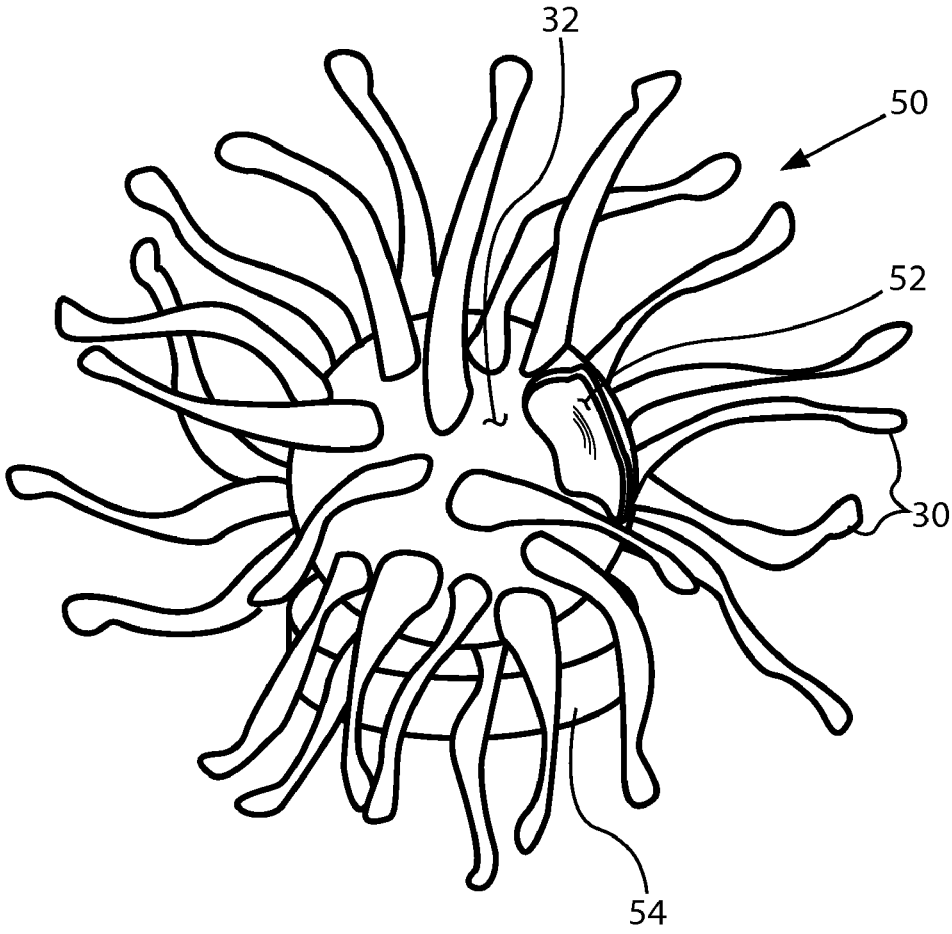
FIG. 3 is a partially fragmented front view of an alternate embodiment of the present invention novelty device.

Referring to FIG. 3, an alternate embodiment of the present invention novelty device 50 is shown. Parts of this embodiment that are identical to those of the first embodiment are identified with the same reference numbers. In this embodiment, a plain housing 52 is provided having a flat base 54 that allows the housing 52 to be free standing. The elastomeric cap 32 is stretched completely over the housing 52 so that the housing 52 is not visible. The housing 52, however, contains an internal vibrating mechanism that makes the housing 52 vibrate. The elastomeric cap 32 with protrusions 30 covers the entire housing 52. Thus, the entire assembly is covered with undulating protrusions 30 when the vibrating mechanism 16 is activated.

Figure 4:
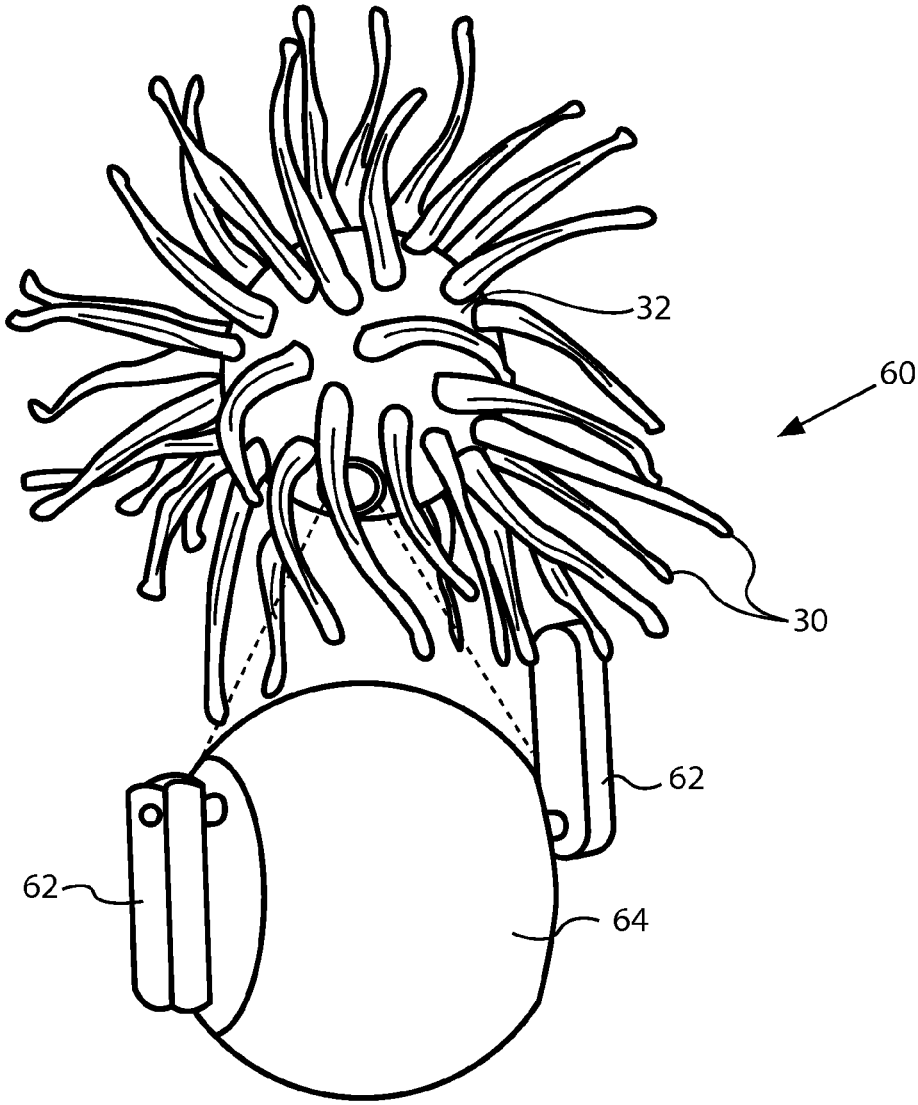
FIG. 4 is an exploded perspective view of a second alternate embodiment of the present invention novelty device.

Referring to FIG. 4, yet another embodiment of the vibration novelty device 60 is shown. In this embodiment, a housing 64 is provided that contains a vibrating mechanism. However, weighted arms 62 from an internal vibrating mechanism extend outside of the housing 64. In this manner, when the vibrating mechanism is activated, the weighted arms 62 spin.

Figure 5:
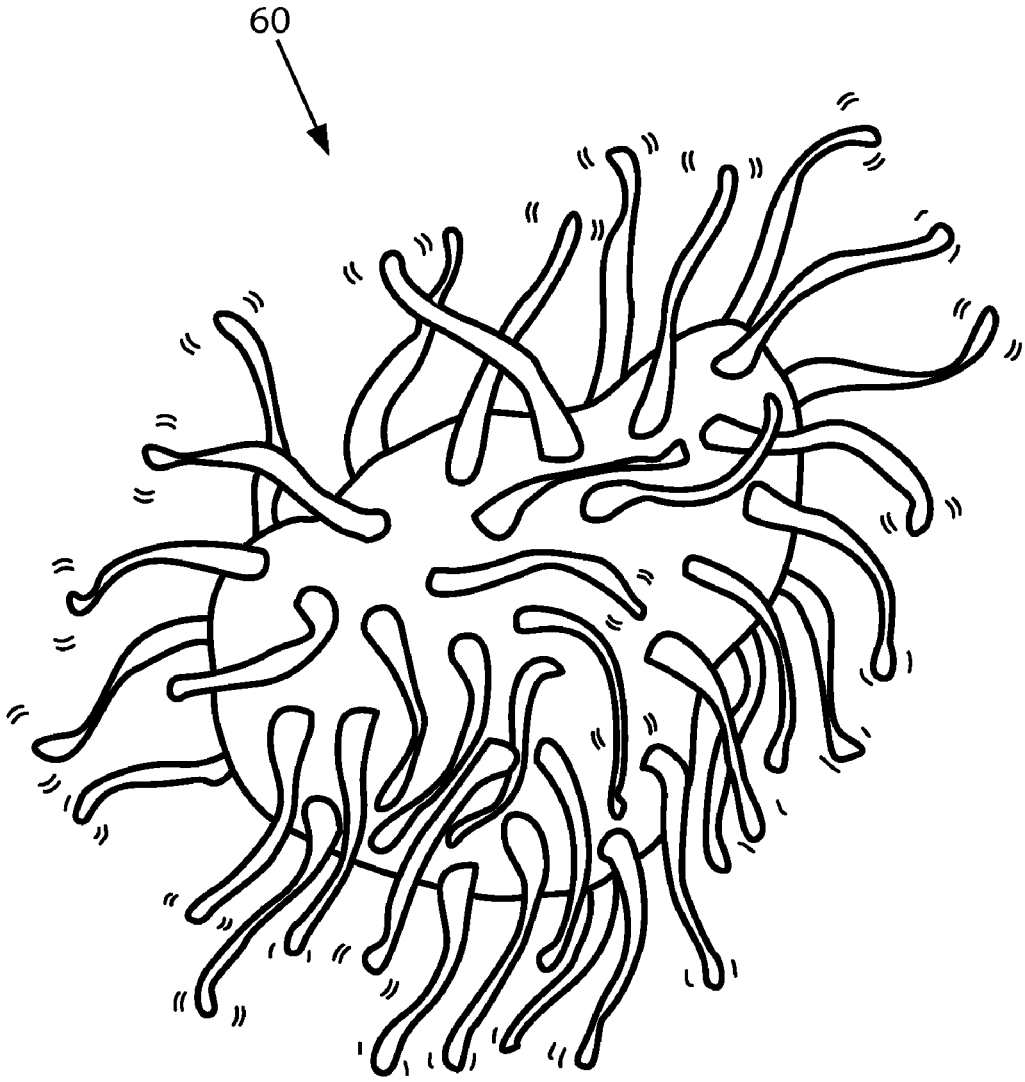
FIG. 5 is a front view of the embodiment of the present invention novelty device shown in FIG. 4.

An elastomeric cap 32 is provided that stretches over both the housing 64 and the weighted arms 62. Referring to FIG. 5 in conjunction with FIG. 4, it can be seen that the material of the elastomeric cap 32 conforms to the housing 64 and the weighted arms 62. The weighted arms 62 move, thereby causing traveling waves of movement in the elastomeric cap 32 by the passage of the weighted arms 62 under the elastomeric cap 32. The rotation of the weighted arms 62 causes a general vibration. This vibration resonates in the protrusions 30 that extend from the elastomeric cap 32, thereby causing the protrusions 30 to writhe. However, the elastomeric cap 32 is also caused to move as the weighted arms 62 pass under different sections of the elastomeric cap 32. This causes the various protrusions 30 to rise and fall as the weighted arms 62 move under them. As a result, not only do the protrusions 30 seem to be alive, but the main body also seems to be alive. This provides further visual and tactile interest to the novelty device 60.

Furthermore, the movement of the weighted arms 62 will also cause the novelty device 60 to move across a surface. The overall assembly will therefore move randomly across a surface as the weighted arms 62 turn. The movement of the weighted arms 62, therefore, can be used as a means to provide locomotion to the novelty device.

In the embodiment of FIG. 4 and FIG. 5, the use of protrusions 30 is optional. The novelty device 60 need not have protrusions and the internal vibrating mechanism may only cause movements in the skin of the elastomeric cap 32 that is stretched over the vibrating mechanism.

It will be understood that the embodiments of the present invention vibrating novelty device are merely exemplary and that a person skilled in the art can make many variations to the shown embodiments using functionally equivalent parts. For instance, the size, shape and appearance of the housing can be changed in many ways. Furthermore, the number, length and position of the various protrusions can also be varied. Finally, the vibrating mechanism can be made to vibrate at many different frequencies and at many different vibrational amplitudes. All such variations, modifications and alternate embodiments are intended to be included within the scope of the present invention as defined by the claims.

What is claimed is:

1. A novelty device, comprising:

a character having a head section;

a vibrating device for vibrating said head section of said character;

an on/off control for selectively activating and deactivating said vibrating mechanism, wherein said on/off control is disposed in said head section of said character;

an elastomeric cover that is stretched over said head section of said character, wherein said elastomeric cover extends over said on/off control; and a plurality of elongated elastomeric protrusions that radially extend from said elastomeric cover so as to emulate hair, wherein said plurality of elongated elastomeric protrusions have a length of greater than one inch and randomly undulate when said vibrating device is activated.

2. The device according to claim 1, wherein said elastomeric cover that is stretched over said head section of said character and can be selectively removed from said head section of said character.

3. The device according to claim 2, wherein said elongated elastomeric protrusions are fabricated from an elastomeric gel.

4. The device according to claim 2 wherein said head section has an exterior surface, wherein a groove is defined in said exterior surface for receiving and retaining said elastomeric cover as said elastomeric cover is stretched over said head section.

5. The device according to claim 1, wherein said character has a body section that is connected to said head section, wherein said vibrating device is disposed in said body section of said character.

6. The device according to claim 1, wherein said plurality of elongated elastomeric protrusions includes at least ten elongated elastomeric protrusions.

7. The device according to claim 6, wherein each of said elongated elastomeric protrusions taper from a first thickness to a smaller second thickness as said elongated elastomeric protrusions extend outwardly from said head section of said character.

* * * * *